United States Patent [19]

Wolma

[11] 4,083,158

[45] Apr. 11, 1978

[54] COPING MOUNTING PLATE

[75] Inventor: Rodney J. Wolma, Grand Rapids, Mich.

[73] Assignee: Philip L. Johnson, Grand Rapids, Mich.

[21] Appl. No.: 749,729

[22] Filed: Dec. 13, 1976

[51] Int. Cl.[2] ..... E04F 19/02

[52] U.S. Cl. ..... 52/300; 52/60; 52/96

[58] Field of Search ..... 52/57, 58, 60, 300, 52/96, 94, 90, 713, 715, 732, 730, 618, 217; 24/201 C; 248/274

[56] References Cited

U.S. PATENT DOCUMENTS

| | | | |
|---|---|---|---|
| 3,156,099 | 11/1964 | Dailey | 24/201 C |
| 3,420,003 | 1/1969 | Cline | 52/217 |
| 3,507,470 | 4/1970 | Gobel | 52/96 |
| 3,851,429 | 12/1974 | Zimmer | 52/60 |
| 3,862,531 | 1/1975 | Attaway | 52/58 |

FOREIGN PATENT DOCUMENTS

| | | | |
|---|---|---|---|
| 1,176,188 | 4/1959 | France | 24/201 C |
| 953,706 | 3/1964 | United Kingdom | 52/732 |
| 1,180,965 | 2/1970 | United Kingdom | 52/300 |

*Primary Examiner*—John E. Murtagh

*Attorney, Agent, or Firm*—Price, Heneveld, Huizenga & Cooper

[57] ABSTRACT

A coping mounting plate for mounting a coping member is connected to a building parapet, wall or the like which extends above a roof deck. The width of the coping mounting plate is adjustable by a plurality of interlocking keys and keyways for accommodating different wall thicknesses.

7 Claims, 5 Drawing Figures

COPING MOUNTING PLATE

BACKGROUND OF THE INVENTION

1. Field of the Invention

The invention relates generally to building structures; and, more particularly, to the capping or covering of a wall, parapet or the like for decorative or functional reasons.

2. Prior Art

The prior art teaches various means of capping walls or parapets extending above the level of a roof. When a coping member is placed on the top of a wall, it serves as a water barrier to prevent seepage of water into the wall and can include decorative panels to enhance the appearance of a building. Various means have been suggested for connecting the coping member to the top of the wall.

The prior art includes placing the coping member on the wall and then driving a nail with a neoprene washer through the coping member. The nail breaks the integrity of the coping member and creates a point for water seepage. The prior art also teaches the use of snap clips fastened to both sides of the wall by nails and having flanges extending outward from the wall. The coping member is formed to have recesses for engaging these outwardly protruding flanges and pressed down on the snap clips thus securing the coping member to the clips and, therefore, to the wall. Unfortunately, proper positioning of these snap clips to receive the coping member can be difficult and time consuming.

Construction of a wall having constant width with perfectly parallel vertical surfaces and horizontal surfaces meeting at right angles to form the top of the wall is difficult. Accordingly, when two separate snap clips are attached to the sides of the wall to receive the coping member, a significant degree of effort and skill is necessary to space and align the snap clips so that a proper snap fit with the coping member occurs. These are some of the difficulties in the installation of coping which this invention alleviates.

SUMMARY OF THE INVENTION

This invention teaches an adjustable width anchor member for a snap-on coping. The anchor member has two snap lock clamps which can be coupled to each other so the width of the combination of the two clamps across the top of the wall can be adjusted. The ability to couple the two clamps together and adjust their combined width provides a more perfectly aligned and positioned anchor member for a snap-on coping. Because the two clamps are coupled to each other, the clamps are not only positioned to the proper width but positioned to be properly aligned with each other to receive the coping member.

This invention provides for increased strength of the anchor member for the snap-on coping and greater ease of installation. An exact fit of the anchor member can be obtained with increased speed by a relatively unskilled worker thus reducing the time and difficulty of installation and the cost of construction. Further, the adjustability of the anchor member permits the same two clamps to be used on walls having a range of widths from the width of a single clamp to about almost the width of both of the clamps. As a result, the same anchor member can be used for coping members of a plurality of widths, thus, extending the usefulness of the part and decreasing the number of sizes that must be inventoried kept in inventory. Such versatility of parts also tends to reduce construction costs.

DETAILED DESCRIPTION OF THE PREFERRED EMBODIMENT

Figure 1:
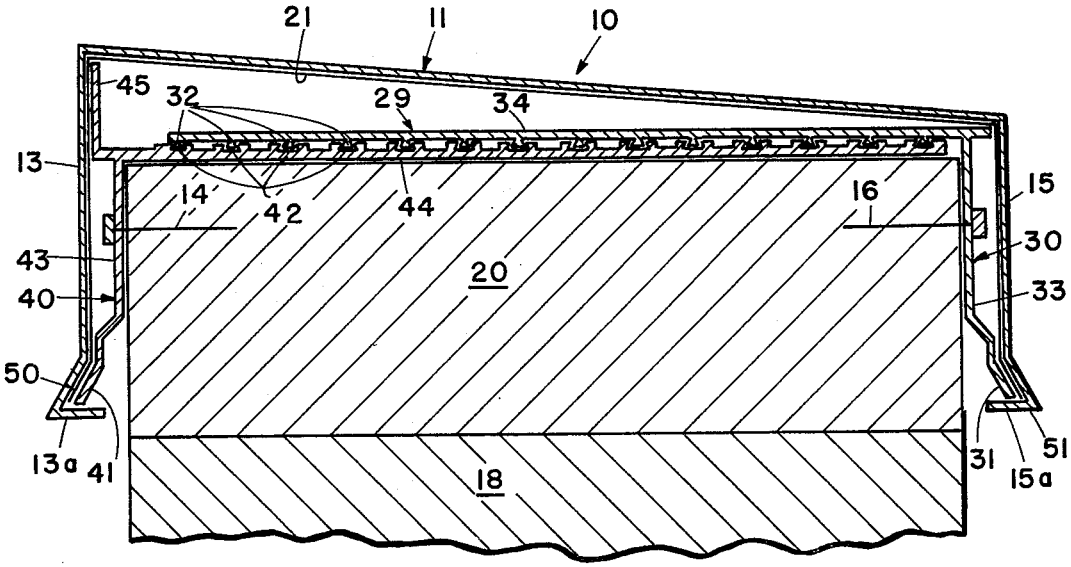
FIG. 1 is a cross section of a coping assembly including a coping member and an adjustable width anchor member for receiving the snap-on coping, the anchor means having two pieces coupled to each other by keys longitudinally slidable in keyways.
Figure 3:
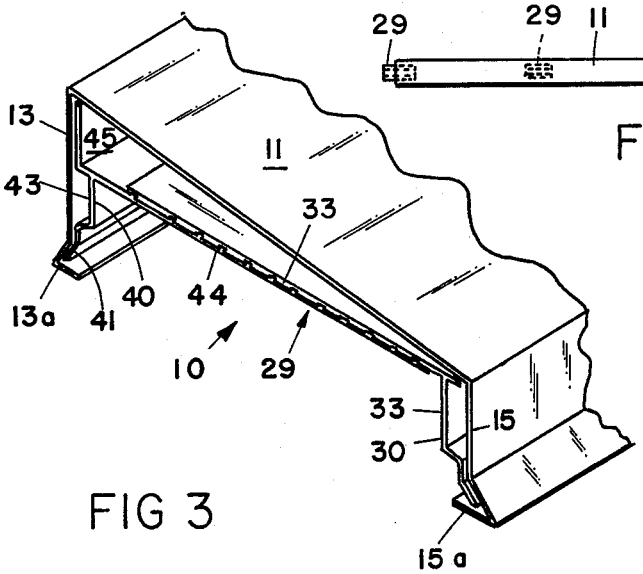
FIG. 3 is a perspective view of the embodiment shown in FIG. 1.

Referring to FIGS. 1 and 3, a coping assembly 10 includes an inverted, generally U-shaped coping member 11 and an adjustable width anchor member 29 including an inside snap lock clamp 30 and an outside snap lock clamp 40. Once clamps 30 and 40 are assembled or discussed below the outside snap lock clamp 40 is coupled to a nailer 20 by a nail 14 and inside snap lock clamp 30 is coupled to nailer 20 by a nail 16. Nailer 20 is conventionally secured to the top of the wall 18. Coping member 11 is then secured over the anchor member.

Outside snap lock clamp 40 has a generally vertical portion 43 extending along the side of nailer 20 and terminating at the bottom by an outwardly protruding segmented flange 41. Clamp 40 further includes an integral horizontal portion 44 extending across the top of nailer 20. Similarly, inside snap lock clamp 30 has a vertical portion 33 extending along the side of nailer 20 and an integral horizontal portion 34 extending across the top of nailer 20. The bottom of vertical portion 33 has an outwardly protruding segmented flange 31 for engaging a coping member. Flanges 31 and 41 both have two outwardly and downwardly extending portions between a vertical portion to improve resiliency of the flange when snapping into a recess of the coping member.

Figure 5:
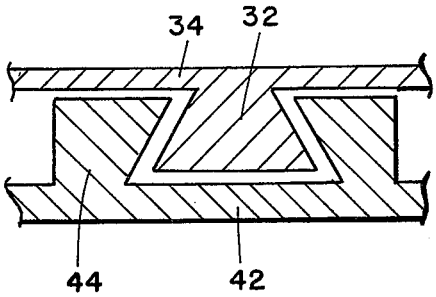
FIG. 5 is an enlarged view of a key and a keyway of the FIG. 1 embodiment.

Horizontal portion 34 of inside clamp 30 has a plurality of horizontally spaced downwardly protruding and longitudinally extending keys 32 which are longitudinally receivable within longitudinally extending horizontally spaced keyways 42 protruding upward from horizontal portion 44 of outside clamp 40 (FIG. 5). Each keyway 42 includes a narrowed longitudinal opening along the length of clamp 40 and downwardly and outwardly shaped sidewalls terminating in a floor to define a generally trapezoidal cross sectional shape. Thus the side walls of keyway 42 slope upward towards each other from the bottom of the keyway to a top thereby forming upward opening slots.

Each key 32 is shaped to slide within keyway 42 and has a similar trapezoidal cross sectional shape. That is, each key 32 has side walls which slope away from each other as they extend downward from portion 34 of clamp 30. The transverse spacing of keyways 42 is the same as the transverse spacing of keys 32 so keys 32 can be positioned to slide along any of keyways 42. Thus the keys are slightly smaller than the keyways to permit this sliding interfit. The tip of the keys naturally is larger than the narrow slot of the keyways to prevent separation of the anchor members except by the sliding relative longitudinal motion. The combined width of clamps 30 and 40 thus can be incrementally increased or decreased by appropriately choosing a key and keyway combination. The positioning of the key and the keyway is advantageously chosen so the combined width of clamps 30 and 40 corresponds to the width of a coping member 11 to be used in cooperation with the clamps. The orthogonal relationship of the horizontal and vertical segments of each anchor member provide automatic alignment of the members as they are positioned against nailer 20.

Coping member 11 has a preferably sloped top 11 extending across the top of nailer 20. Extending vertically downward from the sides of top 11 is a front side 13 and a roof side 15. At the bottom of sides 13 and 15 are inwardly facing lips defining recesses 50 and 51, respectively, for receiving flanges 31 and 41. Sides 13 and 15 have angled ends **13*a* and 15*a* which form the bottom of recesses 50 and 51, respectively, and extend under the bottom flanges of the snap lock clamps. Top 12 of coping member 11 can be horizontal or inclined as shown in FIG. 1. If top 12 is inclined, outside snap lock 40 advantageously integrally includes a vertical riser 45 extending upward from the level of the top of nailer 20 to provide additional support for coping member 11. FIG. 1 also shows a cover plate 21 which follows the inside contours of coping member 11 and is positioned between coping member 11 and clamps 30 and 40. Cover plate 21** acts as a barrier against water seepage.

Figure 4:
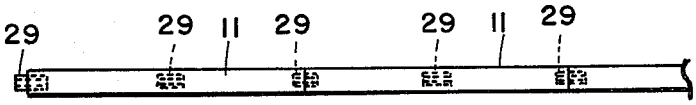
FIG. 4 is a top plan view of an installed coping assembly showing the longitudinal spacing of the anchor members beneath a plurality of adjacent coping sections.

As shown in FIG. 4, each set of clamps 30 and 40 typically extend only a portion of the length of coping member 11. For example, if 10 foot lengths of coping member 11 are used, clamps 30 and 40 can have an 8 inch length and be positioned at the joint between adjacent coping members 11 and halfway between the ends of coping member 11. That is, an 8 inch clamp 30 and 40 would be positioned every 5 feet along coping members 11.

When installing coping assembly 10, outside snap lock clamp 40 is nailed to nailer 20 by nail 14 being driven through vertical portion 43. Inside snap lock clamp 30 is positioned beside clamp 40 so keys 32 are aligned with the end openings of keyways 42 and the total width of clamps 30 and 40 corresponds to the width of the coping member 11 which will be used. Inside clamp 30 is longitudinally moved so keys 32 engage and slide along keyways 42 until clamps 30 and 42 overlap essentially for their entire length. Clamp 30 is secured by driving nail 16 through vertical portion 33 into nailer 20. Flanges 31 and 41 are now securely positioned and properly aligned to receive coping member 11. After plate 21 is positioned over the clamps the coping member is fitted thereover with recesses 50 and 51 at the bottom of front side 13 and roof side 15 respectively snapped down over clamps 30 and 40 so they engage flanges 31 and 41 to complete the installation.

Figure 2:
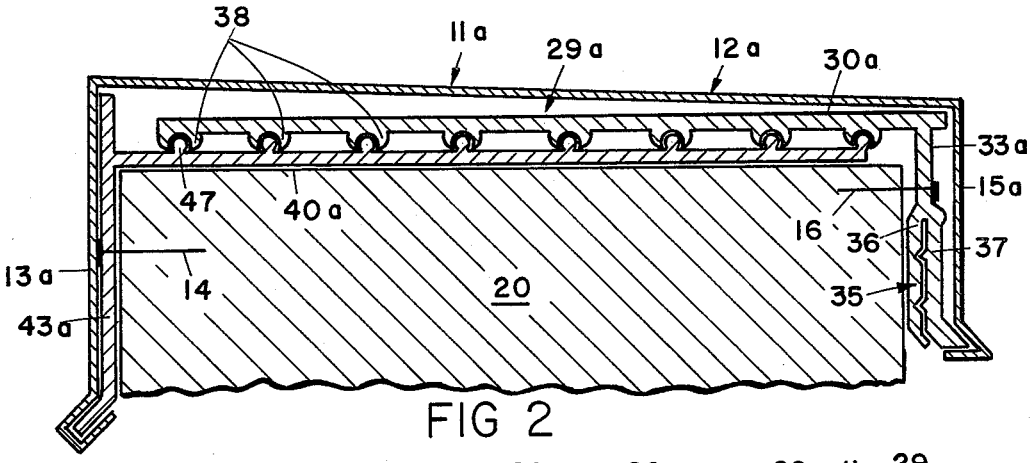
FIG. 2 is a cross section of another embodiment of a coping assembly in accordance with this invention having an anchor member with two pieces coupled to each other using pressure fit snaps.

FIG. 2 shows another embodiment of an adjustable anchor member **29*a* for a snap-on coping. A coping member 11*a* has a generally horizontal top 12*a* and a front side 13*a* and roof side 15*a*. Outside snap lock clamp 40*a* includes a vertical portion 43*a* along the front of nailer 20 and terminates in a flange 41*a* having a single angled protrusion. An inside snap lock clamp 30*a* has a vertical portion 33*a* including a clamp 35 having two legs 36 and 37 deformably coupled to each other so they can be spaced apart to receive a roof flashing such as, for example, a neoprene sheet thereby forming a water tight seal between the roof and the wall. The coupling between clamps 40*a* and 30*a* is different from the coupling between clamps 30 and 40 in that one member does not slide within another member but one member snaps around another member once they are longitudinally and transversely aligned at a desired overall width. Clamp 40*a* has keys 47 extending longitudinally along a horizontal portion 44*a* and having a rib-like top connected to horizontal portion 44*a* by a narrower body. A deformable keyway 33 has a longitudinal opening extending along the length of clamp 30*a* and bounded by two converging walls forming a generally C-shaped cross section. The walls of keyway 38 can be deflected outward so keys 37 can be positioned within keyway 38. That is, keyway 38 snaps over key 37**.

When installing clamps **40*a* and 30*a*, clamp 40*a* is nailed to the nailer 20 as before. However, clamp 30*a* is not longitudinally offset from clamp 40*a* so keys 47 can be engaged by keyway 38. Instead, clamp 30*a* is positioned so the total width of clamps 30*a* and 40*a* is the appropriate width to receive coping member 11*a* and clamp 30*a* is pressed down on clamp 40*a* so the walls of keyways 30*a* spread apart to receive keys 47 within the longitudinal openings of keyways 38. Thus, a pressure fit of keys 37 within keyways 38 is accomplished. If clamp 35 is to be used to hold a neoprene flashing, the flashing is inserted between legs 36 and 37 and they are clamped toward each other before clamp 30*a* is coupled to clamp 40*a*. When clamps 30*a* and 40*a* are in position, coping member 11*a* is snapped on over the clamps. A typical material for the construction of the coping member and the coping mounting plate shown in FIGS. 1 and 2** is extruded aluminum and also molded polymeric material could also be employed.

Various modifications to the preferred embodiment will, no doubt, occur to those skilled in the various arts to which this invention pertains. For example, the particular shape of the keys and the keyways may be varied from the configurations disclosed above. Additionally, the coping member associated with the anchor member can have a different configuration from that disclosed depending upon the construction of the wall and the aesthetic appearance desired. These and all other variations which basically rely on the teachings through which this disclosure has advanced the art are properly considered within the scope of this invention as defined by the appended claims.

The embodiments of the invention in which an exclusive property or privilege is claimed are defined as follows:

1. A two-piece elongated anchor member for positioning over the top of a wall, said member including a first member and a second member for mounting a snap-on coping, said first and second members having sufficiently long portions extending toward each other over the top of the wall so there is an adjustable region of overlap; said two pieces in said region of overlap having a plurality of coupling means adapted to secure said two pieces to each other at any of a plurality of positions thereby adjusting the combined width across the wall of said two-piece anchor member to securely receive the snap-on coping said two pieces securing to each other to prevent relative movement normal to the top of the wall and across the width of the wall, said coupling means having a male key component attached to said first member said second member including a female keyway component; said keyway component adapted to securely enshroud said key component thus rigidly securing said first member to said second member; and said anchor member extending longitudinally along the wall a shorter distance than the snap-on coping so that the snap-on coping is secured by an anchor member at a plurality of longitudinally spaced anchor positions wherein said key and keyway components extend longitudinally along said anchor member and said key components are transversely spaced from each other in increments equal to the transverse spacing of said keyway components, and wherein said keyway component has an enlargeable opening for snapping on said key member.

2. A two-piece elongated anchor member for positioning over the top of a wall, said member including a first member and a second member for mounting a snap-on coping, said first and second members having sufficiently long portions extending toward each other over the top of the wall so there is an adjustable region of overlap; said two pieces in said region of overlap having a plurality of coupling means adapted to secure said two pieces to each other at any of a plurality of positions thereby adjusting the combined width across the wall of said two-piece anchor member to securely receive the snap-on coping said two pieces securing to each other to prevent relative movement normal to the top of the wall and across the width of the wall, said coupling means having a male key component attached to said first member said second member including a female keyway component; said keyway component adapted to securely enshroud said key component thus rigidly securing said first member to said second second member; and said anchor member extending longitudinally along the wall a shorter distance than the snap-on coping so that the snap-on coping is secured by an anchor member at a plurality of longitudinally spaced anchor positions, wherein said key and keyway components extend longitudinally along said anchor member and said key components are transversely spaced from each other in increments equal to the transverse spacing of said keyway components, and wherein said keyway component has a longitudinal slot for slidably receiving in a longitudinal direction said key component; said key component having an enlarged head portion and said keyway components having a longitudinal opening narrower than the widest dimension of said slot, thereby preventing transverse uncoupling of said key and keyway components.

3. A coping assembly for covering the top of a wall element adjacent to a roof comprising:

a first snap lock clamp for attachment to one side of the wall, said clamp including a flanged end extending away from the wall;

a second snap lock clamp for attachment to the opposite side of the wall and having a flanged end extending away from the front face of the wall;

said first and second clamps having sufficiently long portions extending toward each other over the top of the wall so there is a region of overlap; said region of overlap including coupling means on said first and second clamps for rigidly securing said first snap lock clamp to said second snap lock clamp in any one of a plurality of discrete positions thus adjusting the combined width of said snap lock clamps; and a coping member shaped generally as an inverted "U" having flange receiving end recesses so the coping member can be placed over the top of the wall with the recesses of the coping member receiving the flanged ends of said first and second snap lock clamps thereby securing the coping member to the wall; said coping member being exterior of, fitting around the vertical extent of and under at least a portion of said snap lock clamps so as to generally enshroud said clamps.

4. A coping assembly for covering the top of a wall element adjacent to a roof comprising:

a first snap lock clamp for attachment to one side of the wall, said clamp including a flanged end extending away from the wall;

a second snap lock clamp for attachment to the opposite side of the wall and having a flanged end extending away from the front face of the wall;

said first and second clamps having sufficiently long portions extending toward each other over the top of the wall so there is a region of overlap; said region of overlap including coupling means on said first and second clamps for rigidly securing said first snap lock clamp to said second snap lock clamp in any one of a plurality of discrete positions thus adjusting the combined width of said snap lock clamps;

a coping member shaped generally as an inverted "U" having flange receiving end recesses so the coping member can be placed over the top of the wall with the recesses of the coping member receiving the flanged ends of said first and second snap lock clamps thereby securing the coping member to the wall; said coping member being exterior of, fitting around the vertical extent of and under at least a portion of said snap lock clamps so as to generally enshroud said clamps; and said first snap lock clamp includes a deformable clamp interior of said flanged end of said first snap lock clamp for clamping onto a roof flashing thus providing a seal between the roof and the wall.

5. A coping assembly for covering the top of a wall element adjacent to a roof comprising:

a first snap lock clamp for attachment to one side of the wall, said clamp including a flanged end extending away from the wall;

a second snap lock clamp for attachment to the opposite side of the wall and having a flanged end extending away from the front face of the wall;

said first and second clamps having sufficiently long portions extending toward each other over the top of the wall so there is a region of overlap; said region of overlap including coupling means on said first and second clamps for rigidly securing said first snap lock clamp to said second snap lock clamp in any one of a plurality of discrete positions thus adjusting the combined width of said snap lock clamps;

a coping member shaped generally as an inverted "U" having flange receiving end recesses so the coping member can be placed over the top of the wall with the recesses of the coping member receiving the flanged ends of said first and second snap lock clamps thereby securing the coping member to the wall; said coping member being exterior of, fitting around the vertical extent of and under at least a portion of said snap lock clamps so as to generally enshroud said clamps; and pairs of a first and a second snap lock clamp are spaced along the length of the wall; and said coping member is substantially continuous along the length of the wall and coupled at intervals to said pairs of snap lock clamps.

6. A coping assembly as defined in claim 5 wherein said first and second snap lock clamps are extruded of aluminum.

7. A coping assembly as defined in claim 6 further comprising a cover plate positioned intermediate said coping member and said clamps.

* * * * *